US005611663A

United States Patent [19]

Kotzur

[11] Patent Number: 5,611,663

[45] Date of Patent: Mar. 18, 1997

[54] GEARED MULTISHAFT TURBOCOMPRESSOR AND GEARED MULTISHAFT RADIAL EXPANDER

[75] Inventor: Joachim Kotzur, Oberhausen, Germany

[73] Assignee: MAN Gutehoffnungshütte Aktiengesellschaft, Oberhausen, Germany

[21] Appl. No.: 437,402

[22] Filed: May 9, 1995

[30] Foreign Application Priority Data

May 10, 1994 [DE] Germany ..... 44 16 497.1

[51] Int. Cl.[6] ..... F03B 11/02

[52] U.S. Cl. ..... 415/122.1; 415/66; 415/179

[58] Field of Search ..... 415/122.1, 60, 415/62, 66, 179

[56] References Cited

U.S. PATENT DOCUMENTS

| | | | |
|---|---|---|---|
| 3,001,692 | 9/1961 | Schierl | 415/66 |
| 3,809,493 | 5/1974 | Pilarczyk | 415/122.1 |
| 4,105,372 | 8/1978 | Mishina et al. | 415/66 |
| 4,219,306 | 8/1980 | Fujino et al. | 415/66 |
| 5,402,631 | 4/1995 | Wulf | 415/66 |

FOREIGN PATENT DOCUMENTS

| | | | |
|---|---|---|---|
| 1813335 | 7/1969 | Germany | 415/66 |
| 2250892 | 4/1973 | Germany | 415/179 |
| 2518628A1 | 10/1976 | Germany . | |
| 4234739C1 | 11/1993 | Germany . | |
| 3192990 | 8/1988 | Japan | 415/66 |
| 0102821 | 8/1922 | Switzerland | 415/179 |
| 0615251 | 7/1978 | U.S.S.R. | 415/60 |

*Primary Examiner*—Edward K. Look
*Assistant Examiner*—Mark Sgantzos
*Attorney, Agent, or Firm*—McGlew and Tuttle

[57] ABSTRACT

A geared multishaft turbocompressor with impellers arranged in series in terms of flow, which are fastened to two or more pinion shafts, which are arranged in parallel to one another and are driven directly via a central gear or indirectly via pinion shafts on the circumference of the central gear. Two or more compressor impellers are arranged in the same direction of flow in the area of the high-pressure stages III and IV on a pinion shaft. An intercooler is arranged between an intermediate outlet housing and an intermediate inlet nozzle. In stage III, the gas enters the impeller through the inlet nozzle, and it leaves the compressor via an intermediate outlet housing. After intercooling, the gas again enters stage IV via the inlet nozzle, and it leaves this stage via the outlet housing after flowing through the second impeller. An analogous arrangement of the stages Ia, IIa, IIIa is used in the radial expander, with opposite direction of the gas flow.

11 Claims, 5 Drawing Sheets

GEARED MULTISHAFT TURBOCOMPRESSOR AND GEARED MULTISHAFT RADIAL EXPANDER

FIELD OF THE INVENTION

The present invention pertains to a multistage geared multishaft turbocompressor with impellers connected in series in terms of flow, wherein two or more compressor impellers, which are driven, in relation to the pinion shafts, directly via a central gear or indirectly via pinion shafts on the circumference of the central gear, are attached to one or more pinion shafts arranged in parallel to one another, wherein a plurality of impellers are arranged one behind the other in the same direction of flow from the inlet nozzle at the pinion shaft end in the direction of the gearbox case, via the intermediary of a disk diffuser in the high-pressure stages following the low-pressure stages (first or first and second pinion shafts).

The power can be transmitted to the compressor impellers in the latter case via the pinion shaft of the drive via a central gear via the pinion shaft of the compressor impellers or the central gear via the intermediate gears via the pinion shaft of the compressor impeller.

BACKGROUND OF THE INVENTION

To solve the problems occurring at the high overall pressure ratios concerning the high pinion shaft speeds, a plurality of impellers are arranged in series in the stages following the low-pressure stages (first or second pinion shaft) beginning from the second or third pinion shaft, via the intermediary of a disk diffuser and of a return ring to at least one pinion shaft according to DE 42 34 739.

The drawback of this design is that no intercooling takes place after each impeller at higher pressure ratios of the stage groups.

The solution described in DE-OS 25 18 628, in which one pair of impellers each is arranged back to back on the pinion shaft, makes such intercooling possible, but it even leads to impairments in terms of rotor dynamics, because a great distance between the center of gravity of the overhanging rotor part and the pinion shaft bearing develops here due to the radial inlet nozzle arranged between the gearbox case and the impeller.

SUMMARY AND OBJECTS OF THE INVENTION

The primary object of the present invention is to provide a geared multishaft turbocompressor, which avoids the above-mentioned disadvantages of the state of the art, and in which the overall efficiency and the overall pressure ratio can be increased at equal speed, without having to accept rotor dynamic disadvantages.

According to the invention, a multistage geared multishaft turbocompressor is provided including a first pinion shaft and a second pinion shaft. Drive means are provided including either a central gear directly driving the first pinion shaft and the second pinion shaft or via intermediary gears driving the first pinion shaft and the second pinion shaft. The first pinion shaft is arranged in parallel to the second pinion shaft. Additional pinion shafts may be provided however the first pinion shaft is provided with impellers of low pressure stages. The second or last pinion shaft is provided with impellers defining high pressure stages including a first high pressure stage and a last high pressure stage with an outlet housing. The high pressure stage group includes a plurality of impellers arranged in a same direction of flow from an inlet nozzle at the pinion shaft end in a direction of a gearbox case centrally supporting the second or last pinion shaft. The impellers are provided disposed one behind the other, via the intermediary of a disk diffuser. An intercooler is provided for cooling gas between the high pressure stages. The disk diffuser of the stage upstream of the intercooler is joined by an intermediate inlet nozzle by which the gas is fed into the intercooler. The intercooler is joined by an intermediate intake fitting which feeds the gas from the intercooler to the stage with the outlet housing.

This is accomplished according to the present invention by a plurality of impellers being arranged in series in the same direction of flow from the pinion shaft end in the direction of the gearbox case in the stages following the low-pressure stages (first or first and second pinion shafts), via the intermediary of an intermediate outlet housing of an intercooler as well as of an intermediate inlet housing to the next stage.

The distance of the center of gravity of the overhanging shaft part now remains on the same order of magnitude as in the solution according to DE 42 34 739, especially in the case of the design of the spiral housing with axially asymmetric position of the spiral cross section to the impeller outlets, namely, asymmetrically in the direction of the pinion shaft end at the intermediate outlet housing and in the direction of the gearbox case at the outlet housing.

The low-pressure stages may be designed as prior-art single stages with high flow coefficient and high circumferential velocity, mostly with impellers of semi-open design without cover disk. The high-pressure stages in the stage groups are usually designed with impellers with cover disks, but the cover disk may also be omitted in the first stage of the high-pressure stage group.

If the impellers of the high-pressure stage groups are connected to one another by radial serrations and central bolts, the inner housings may be designed as horizontally unsplit housings even in the case of a horizontally unsplit outer housing.

If the impellers are rigidly connected to one another for rotor-dynamic reasons, this requires a horizontal split of at least the inner housing of the intermediate inlet housing.

By reversing the direction of flow, a multishaft radial expander is formed, in which the possibility of intermediate superheating of the gas can be utilized by inserting the intermediate outlet housing and the intermediate inlet housing.

By arranging compressor and radial expander stage groups together on one pinion shaft and by correspondingly arranging compressor and radial expander stages with high flow coefficient in the low-pressure part, it is possible to reach maximum overall pressure ratios of turbocompressors and radial expanders with only one gear mechanism.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF FIGURE 1

Figure 1:
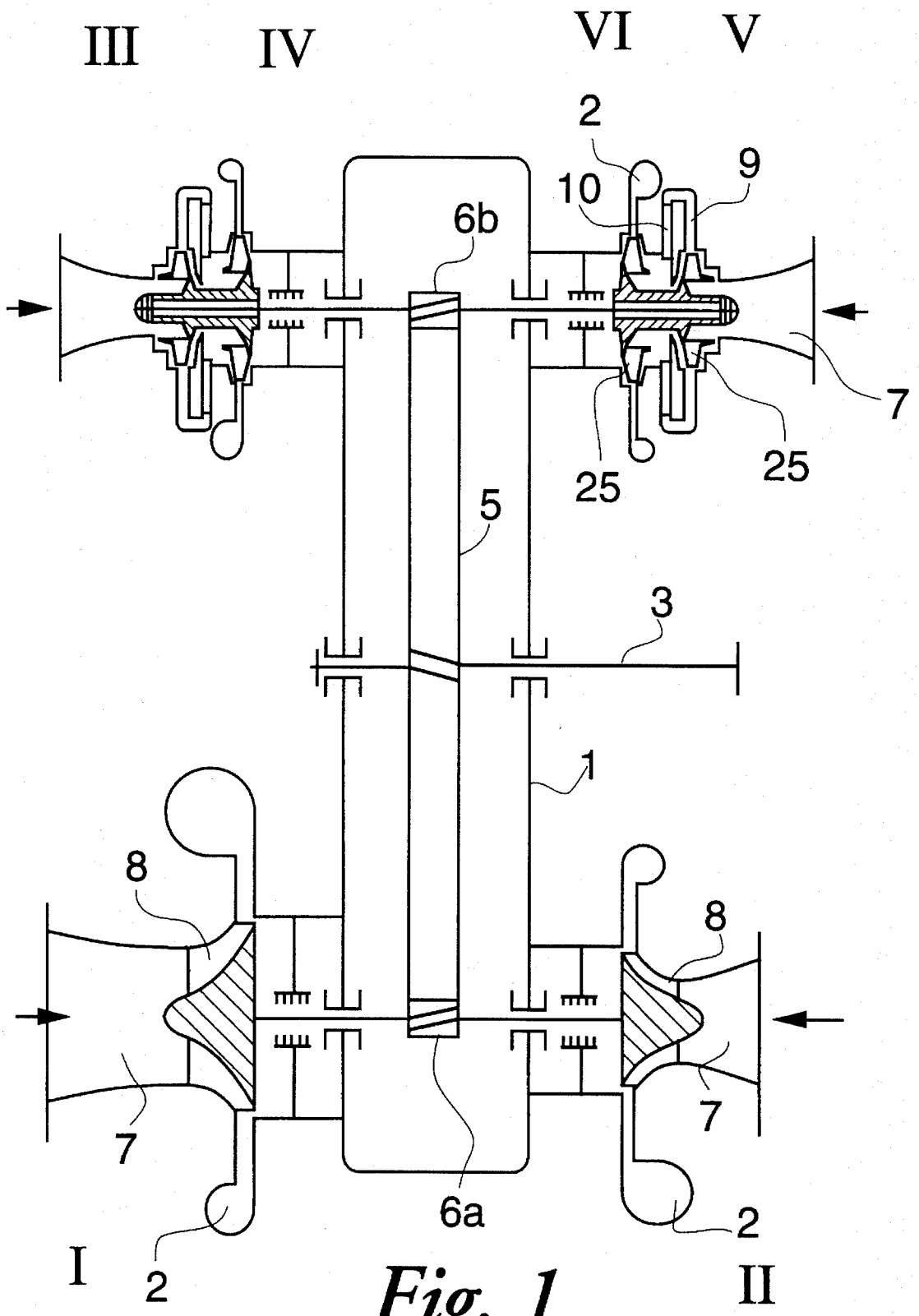
Fig. 1 (PRIOR ART)
FIG. 1 is a schematic sectional view taken through the split line of a turbocompressor according to either the state of the art or the prior art.

FIG. 1 shows a section through a horizontal split line of a prior-art geared multishaft compressor. The turbocompressor with the inlet nozzle 7 and the outlet housing 2 is equipped with a low-pressure shaft 6*a* with the individual stages I and II with impellers 8 of a semi-open design without cover disk, as well as with a high-pressure shaft 6*b* with the stage groups III, IV as well as V, VI.

Two compressor impellers 25 each with cover disk are arranged in the same direction on the high-pressure shaft. Disk diffusers 9 and return rings 10 are inserted. A drive means drives the shaft 1 of directly via a central gear 5 or indirectly via pinion shafts on the circumference of the central gear 5. The central gear 5 is driven by, or drives, a drive shaft 3.

DETAILED DESCRIPTION OF THE PREFERRED EMBODIMENT

Figure 2:
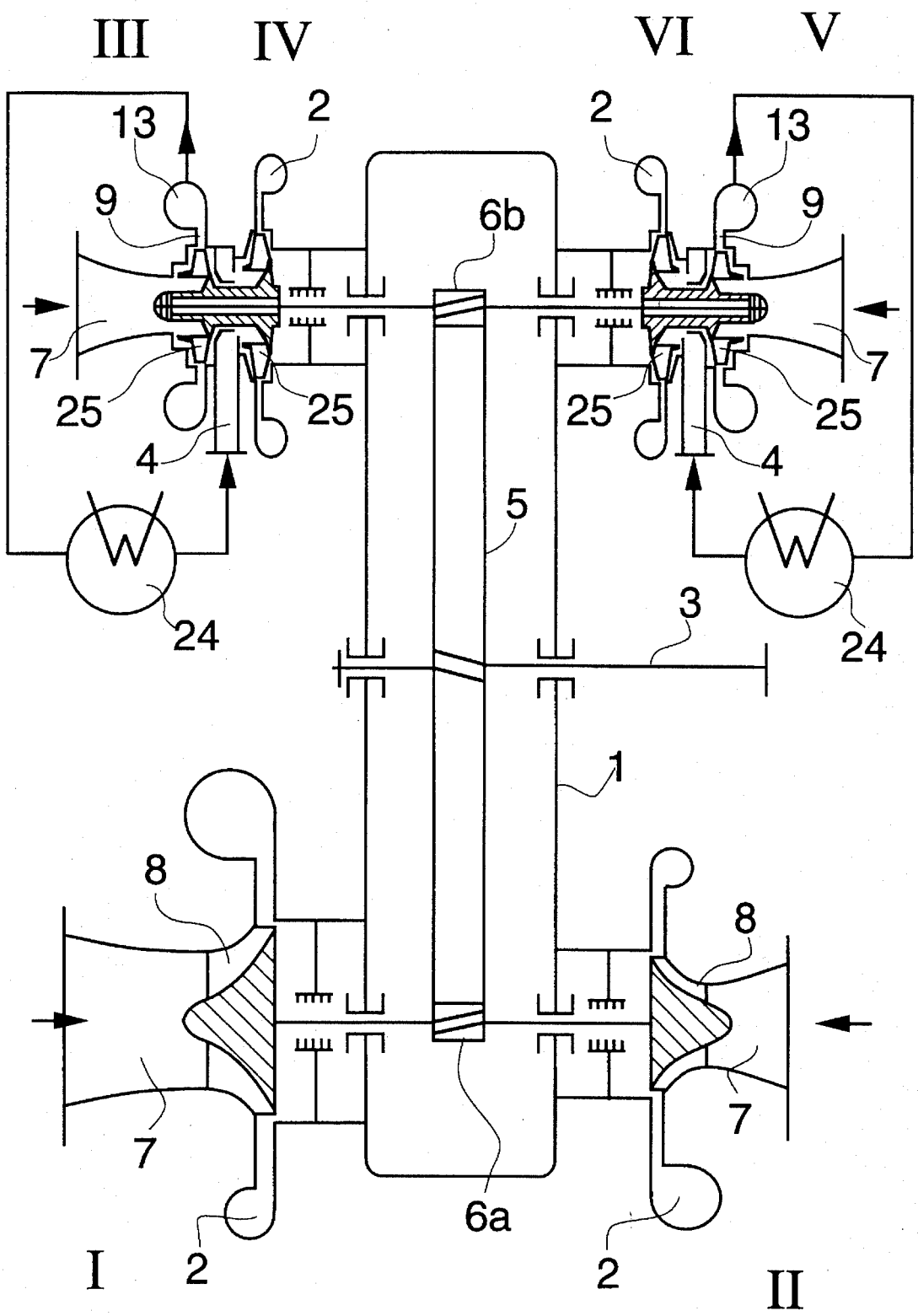
FIG. 2 is a schematic sectional view taken through the split line of a geared multishaft turbocompressor according to the present invention with a prior-art low-pressure shaft and a novel high-pressure shaft.

FIG. 2 shows a section through a horizontal split line of a turbocompressor according to the present invention. The low-pressure part is equipped here with a known per se low-pressure shaft 6*b* with the individual stages I and II with impellers 8 of a semi-open design and with a novel high-pressure shaft 6*a* with the stages III and IV as well as V and VI with impellers 25 with cover disk. The order of the impellers in the direction of flow in the compressor is I, II, III, IV, V, VI. In stage III, the gas enters the impeller 25 axially via the inlet nozzle 7 and leaves the compressor via an intermediate outlet housing 13. After intercooling (intercooler 24), the gas again enters, via the intermediate inlet nozzle 4 the stage group III–IV of this pinion shaft end 6*b*, and it leaves the stage group III–IV after flowing through the impeller 25 of stage IV via the outlet housing 2.

This analogously applies to the stage group V–VI as well.

Figure 3:
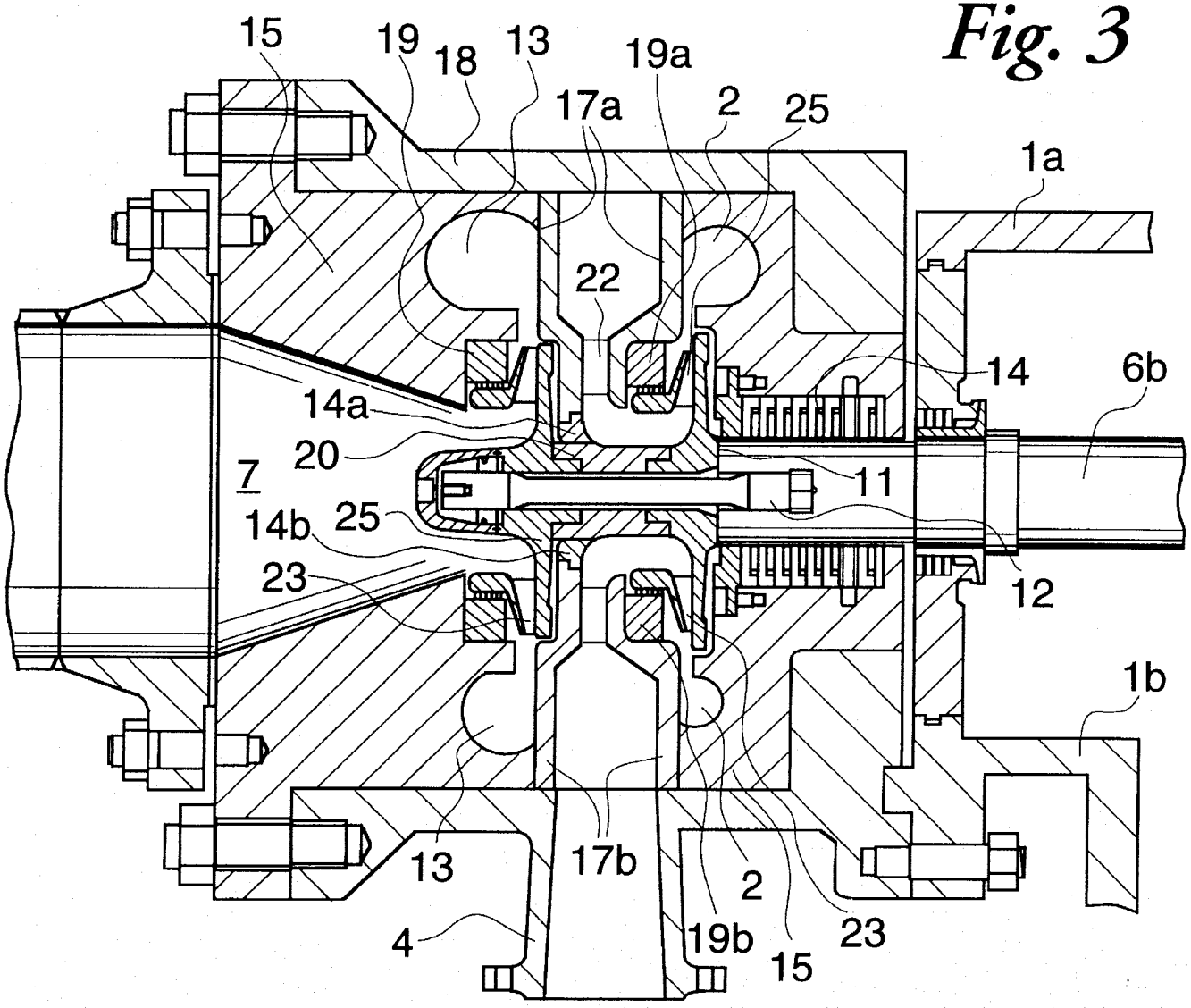
FIG. 3 is a sectional view taken through a stage group according to the present invention with horizontally unsplit inner housings.

FIG. 3 shows a vertical longitudinal section through a stage group III–IV or V–VI of a geared multishaft turbocompressor according to the present invention.

The two stages of the stage group III–IV or V–VI are accommodated here in a horizontally unsplit outer housing 18. The suction to the first impeller 25 takes place axially via an inlet nozzle 7, which is arranged in the horizontally unsplit inner housing 15.

The intermediate outlet housing 13 after the impeller 25, via whose pipe connection (see FIG. 2) in the outer housing 18 the gas is discharged to the intercooler (see FIG. 2), is also arranged in this inner housing 15. Via the intermediate inlet nozzle 4 and the guide vanes 22 in the inlet chamber, the gas again enters the stage group. Since both impellers 25 are rigidly connected to one another by the connection sleeve 20 prior to mounting on the pinion shaft 6*b*, the inner housing 17, 17*b* with the inlet chamber must be designed as a horizontally split housing. After leaving the second impeller 25, the gas leaves the stage group through the outlet housing 2 via a pipe connection (not shown here) on the outer housing 18. The intermediate outlet housing 13 and the outlet housing 2 are arranged asymmetrically to the impeller outlets 23 of the upstream impellers 25 in relation to their flow cross sections, namely, in the direction of the axial inlet nozzle 7 in the intermediate outlet housing 13 of the first stage of the stage group, and in the direction of the gearbox case 1*a*, 1*b* in the outlet housing 2 of the second stage. The space necessary for the inner housing 17*a*, 17*b* with the inlet chamber is obtained as a result, without increasing the length of the pinion shaft end compared with the prior-art solution (FIG. 1).

The two impellers 25 rigidly connected to one another by a connection sleeve 20 are fastened to the pinion shaft by the radial serrations 11 and the central fastening bolt 12. The impellers are connected to one another here by shrinking the impellers 25 into the connection sleeve 20. A shaft seal 14 is positioned at one end of the shaft 6 with horizontally split upper and lower shaft seal parts 14*a* and 14*b* respectively. Element 19 is an impeller seal with a horizontally split impeller seal upper part 19*a* and a horizontally split impeller seal lower part 19*b*.

Figure 4:
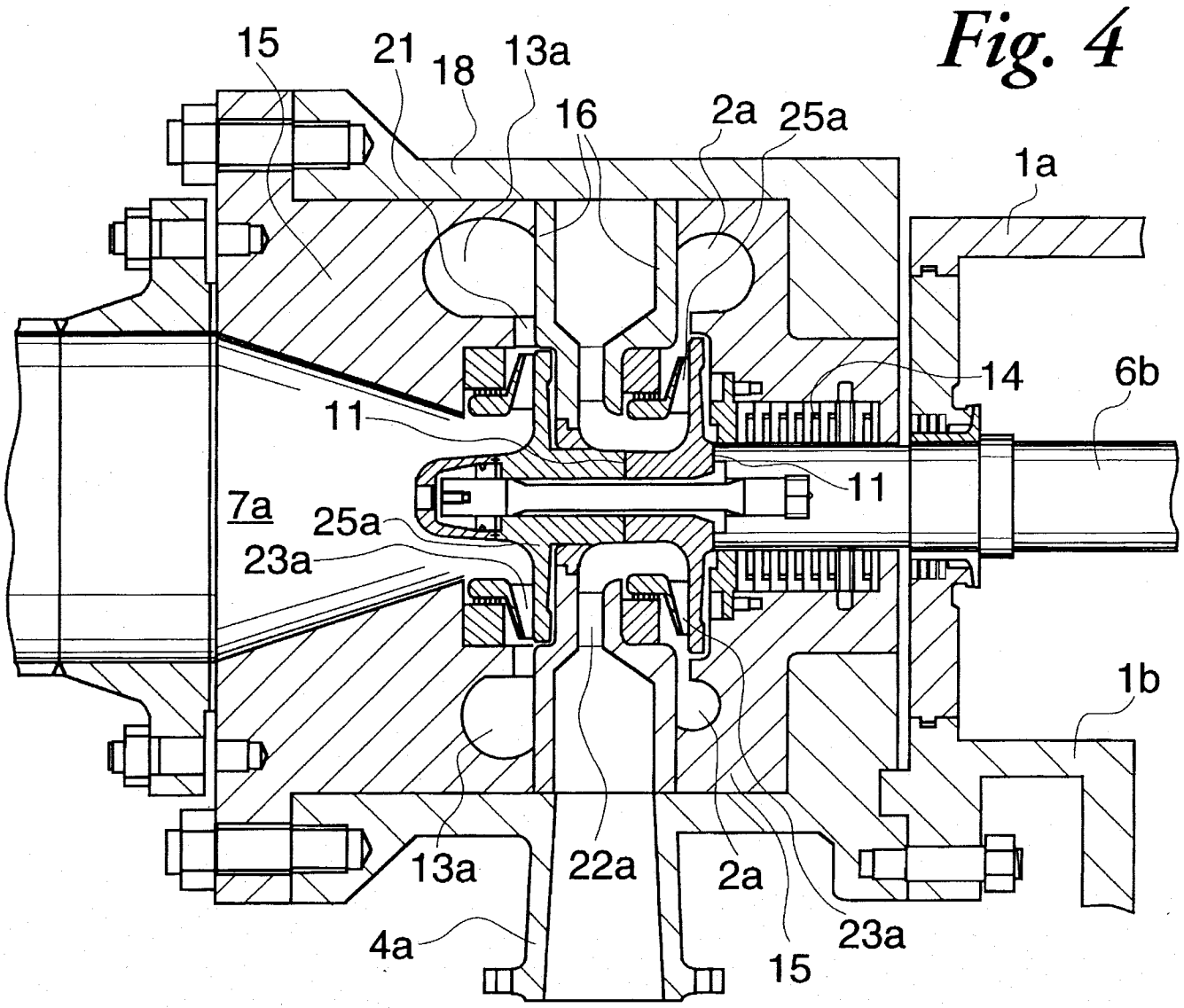
FIG. 4 is a sectional view taken through a stage group according to the present invention with horizontally split intermediate housing.

FIG. 4 shows a stage arrangement according to FIG. 3 designed as a multishaft radial expander. The gas enters the stage group have via a pipe connection (not shown here) on the outer housing 18 and via the inlet housing 2*a* of the stage adjacent to the gearbox case (gearbox case upper part 1*a*, gearbox case lower part 1*b*), and it leaves the stage group via the guide vanes 22*a* in the outlet chamber and the inner housing via the outlet chamber 16 and with the pipe connection 4*a* arranged on the outer housing 18.

After an external intermediate superheating, the gas enters the impeller 25*a* via a pipe connection (not shown here) arranged on the outer housing 18 and via the intermediate inlet housing 13*a* of the impeller 25*a* arranged at the pinion shaft end and via guide vanes 21.

After leaving the impellers 25*a*, the gas flows off via the axial outlet fitting 7*a*.

Since the two bladed wheels 25*a* are connected to one another via radial serrations 11, the inner housing 16 with the outlet space does not need to be horizontally split for mounting.

Figure 5:
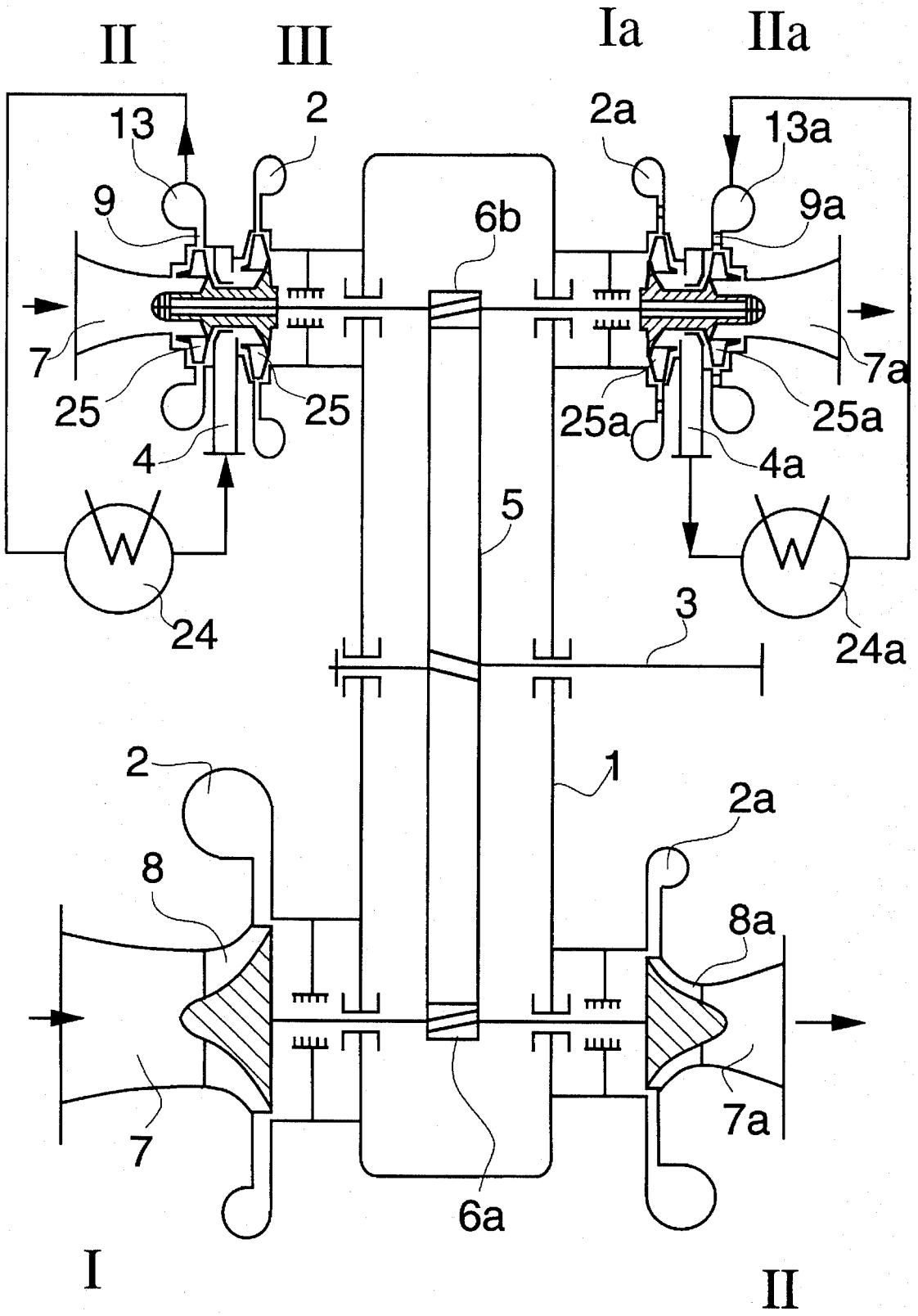
FIG. 5 is a schematic sectional view showing a combination according to the present invention of multishaft turbocompressor (left) and radial expander stage groups (right).

Finally, FIG. 5 shows a combination of a geared multishaft turbocompressor according to the present invention (left half of the figure) with a multishaft radial expander according to the present invention (right half of the figure), which are arranged on a common gearbox case 1 on common pinion shafts 6*a*, 6*b*.

The low-pressure stage I of the geared multishaft turbocompressor corresponds to the low-pressure stage III*a* of the multishaft radial expander in the lower part of FIG. 5.

The high-pressure stages II, III of the geared multishaft turbocompressor and the high-pressure stages Ia, IIa of the multishaft radial expander can be recognized in the upper part of FIG. 5.

The inlet housings 2a of the radial expander correspond to the outlet housings 2 on the compressor side. The intermediate inlet housing 13a corresponds to the intermediate outlet housing 13, and the intermediate outlet nozzle 4a corresponds to the intermediate inlet nozzle 4. The axial inlet nozzle 7 is represented here by the axial outlet nozzle 7a, which is designed as an outlet diffuser, and the disk diffuser 9 is represented by the disk annular space 9a in the multishaft radial expander. Element 24a is an intermediate superheater.

The impellers 8a, 25a correspond to the impellers 8, 25 of the compressor in the radial expander. The order of the impellers in the direction of flow in the radial expander is Ia, IIa, IIIa, IVa, Va, VIa.

While specific embodiments of the invention have been shown and described in detail to illustrate the application of the principles of the invention, it will be understood that the invention may be embodied otherwise without departing from such principles.

I claim:

1. A multistage geared multishaft turbocompressor comprising: a first shaft with impellers of low pressure stages and a second shaft with impellers of high pressure stages; drive means for driving said shafts one of directly via a central gear and indirectly via pinion shafts on the circumference of the central gear, said first shaft being arranged in parallel to said second shaft, said high pressure stages comprising a plurality of impellers arranged in a same direction of flow from an inlet nozzle at an end of said second shaft in a direction of a central gearbox case, one behind the other, via an intermediary of a disk diffuser, to provide a first high pressure stage and a next high pressure stage, said next stage including an outlet housing; an intermediate outlet housing joining said disk diffuser said intermediate outlet housing being a spiral housing; an intercooler connected to said intermediate outlet housing; and an intermediate inlet connected to said intercooler and connected to said next stage of said high pressure stages, said intermediate housing being a spiral housing.

2. A multistage geared multishaft turbocompressor in accordance with claim 1 wherein said intermediate outlet housing has, in relation to a impeller outlet of said outlet housing, an asymmetric flow cross section in the direction of the said inlet impeller at the pinion shaft end, and said outlet housing of an associated stage group of said high pressure stages has an asymmetric flow cross section to said impeller outlet in a direction of a central gearbox case.

3. A multistage geared multishaft turbocompressor according to claim 1, wherein said drive means includes a reverse drive for operating said multishaft turbocompressor as a multishaft radial expander to reverse a direction of flow whereby gas is introduced through said inlet housing and gas is discharged through said axial outlet diffuser.

4. A multistage geared multistage turbocompressor in accordance with claim 3, wherein said outlet housing of said high-pressure stages of the geared multishaft turbocompressor is also designed to be an inlet housing of a multishaft radial expander; said disk diffuser of said high-pressure stages of the geared multishaft turbocompressor being used as an inlet disk annular space of a multishaft radial expander; said impellers of the geared multishaft turbocompressor are used as impellers of the multishaft radial expander; said intermediate inlet nozzle of tile geared multishaft turbocompressor is used as an intermediate outlet nozzle of the multishaft radial expander; said intermediate outlet housing of the geared multishaft turbocompressor is also designed to be an intermediate inlet housing of the multishaft radial expander; and said inlet nozzle of the geared multishaft turbocompressor is also designed to be an outlet nozzle of the multishaft radial expander.

5. A multistage geared multishaft turbocompressor according to claim 1 further comprising multishaft radial expanders arranged on said second shaft along with said high pressure stage group of said geared multishaft turbocompressor.

6. A multistage geared multishaft radial expander comprising: a first shaft with impellers of low pressure stages and a second shaft with impellers of high pressure stages; gear means for connection to said shafts one of directly via a central gear and indirectly via pinion shafts on the circumference of the central gear, said first shaft being arranged in parallel to said second shaft, said high pressure stages comprising a plurality of impellers arranged in a same direction of flow, between a nozzle at an end of said second shaft and a direction of a central gearbox case, one behind the other, via an intermediary of an inlet disk annular space, to provide a first high pressure stage and a next high pressure stage, said next stage including an inlet housing; an intermediate inlet housing joining said disk annular space; an intercooler connected to said intermediate inlet housing; and an intermediate outlet connected to said intercooler and connected to said next stage of said high pressure stages.

7. A multistage geared multishaft turbine comprising:

a gearbox;

a shaft having an end extending out of said gearbox;

a plurality of impellers mounted on said end of said shaft;

a first pressure stage and a second pressure stage arranged on said shaft end and formed with said plurality of impellers in a same direction of flow, said first pressure stage including a disk diffuser and an intermediate outlet housing connected to said disk diffuser, said second pressure stage including an intermediate inlet and an outlet housing, said intermediate outlet housing has an impeller outlet and said intermediate outlet housing has a flow cross section asymmetrical with respect to said impeller outlet, said flow cross section being offset in a direction of the shaft end, and said outlet housing of second pressure stage having an impeller outlet and an asymmetric flow cross section with respect to said impeller outlet offset in a direction of said gearbox.

8. A turbine in accordance with claim 7, wherein:

said first pressure stage is mounted on said end of said shaft;

said second pressure stage is mounted between said first pressure stage and said gearbox, said second pressure stage having a same direction of flow as said first pressure stage and being connected in series with said first pressure stage;

said intermediate outlet housing extends more towards said end of said shaft than towards said gearbox;

said outlet housing extends more towards said gearbox than towards said end of said shaft.

9. A turbine in accordance with claim 7, wherein:

said intermediate outlet housing does not extend further than said disk diffuser toward said gearbox;

said outlet housing does not extend further than said impeller outlet toward said end of said shaft.

10. A turbine in accordance with claim 7, wherein:

said asymmetric flow cross sections of said outlet and intermediate outlet housing are symmetrical about a center and said center is offset from a center of respective said impeller outlets.

11. A multistage geared multishaft turbocompressor according to claim 10, wherein: said intermediate outlet housing is a spiral housing.

* * * * *